United States Patent [19]

Jamell

[11] 3,956,950

[45] May 18, 1976

[54] ELECTRICAL TOOL

[76] Inventor: Francis A. Jamell, 805 S. 11th Ave., Marshalltown, Iowa 50158

[22] Filed: June 9, 1975

[21] Appl. No.: 584,750

[52] U.S. Cl. ..... 81/426; 140/104
[51] Int. Cl.[2] ..... B25B 7/02
[58] Field of Search ..... 81/425, 426, 5.1 R; 140/106, 104; 7/3 R

[56] References Cited

UNITED STATES PATENTS

| | | | |
|---|---|---|---|
| 391,227 | 10/1888 | Ruckman | 140/106 |
| 1,602,119 | 10/1926 | Niebaum | 140/106 |
| 1,666,801 | 4/1928 | Varney | 140/106 |
| 3,831,207 | 8/1974 | Boyajian | 7/3 R |

FOREIGN PATENTS OR APPLICATIONS

| | | | |
|---|---|---|---|
| 564,698 | 11/1932 | Germany | 140/106 |

*Primary Examiner*—James L. Jones, Jr.
*Attorney, Agent, or Firm*—Zarley, McKee, Thomte, Voorhees & Sease

[57] ABSTRACT

A pair of scissorlike members are pivotally interconnected and include opposed jaw portions. One of the jaws includes a concave passageway extending along its substantial length and a plurality of spaced apart transversely extending grooves are formed in said passageway. The other jaw is truncated in shape and matingly engages the passageway when the jaws are closed. A length of wire may be received in the groove and when the jaws are closed the wire is deformed into a U-shape.

4 Claims, 8 Drawing Figures

ELECTRICAL TOOL

BACKGROUND OF THE INVENTION

In electrical work it is commonly necessary to form eye portions on pieces of electrical wire for purposes of receiving screws to attach the wires to electrical terminals. Heretofore these loops have been formed manually in various ways. No hand tool for forming these loops has been previously available to the electrician.

SUMMARY OF THE INVENTION

This invention includes a pair of scissorlike members pivotally interconnected with one of the members having a jaw portion including a semicircular in cross section passageway which increases in cross section from the outer end inwardly. The other jaw portion is a finger-like element which is cylindrical in cross section and is adapted to matingly engage the passageway. A plurality of spaced apart transversely extending grooves are provided in the concave passageway to receive wire lengths to be deformed into terminal ends. This invention is capable of providing wire loop ends of varying sizes as needed. The U-shaped loop in the wire end portion is formed by spacing the length of the wire in one of the grooves for the size of loop desired and then closing the jaws. The result is a U-shaped loop which then may be furthere deformed by the end portions of the tool into a substantially circular end portion. The tool is also provided with oppositely disposed opposing cutting edges for cutting the wire as necessary.

DESCRIPTION OF THE INVENTION.

Figure 1:
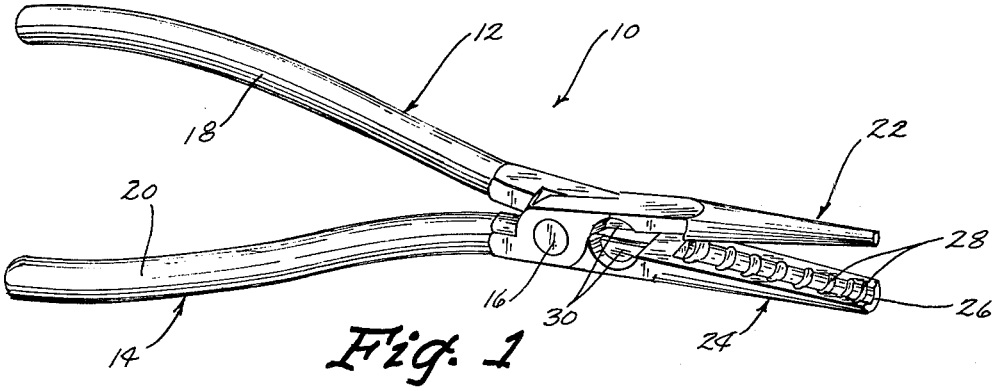
FIG. 1 is a persepective view of the electrical tool of this invention.

The electrical tool of this invention is referred to generally in FIG. 1 by reference numeral 10 and includes a pair of members 12 and 14 pivotally interconnected by a pin 16 to function like scissors. Members 12 and 14 include handle portions 18 and 20 and oppositely disposed jaw portions 22 and 24.

The jaw 24 is provided with a longitudinally extending passageway 26 semicircular in cross section and increasing in diameter from the outer end inwardly. A plurality of transversely extending spaced apart grooves 28 are provided in the passageway 26 to receive different size wire portions to form different size loop ends. The jaw portion 22 is truncated in shape and matingly engages the passageway 26 in the jaw portion 24.

Adjacent the pivot pin 16 are a pair of opposed cutting edges 30 on the jaw portions for cutting desired wire lengths.

Figure 4:
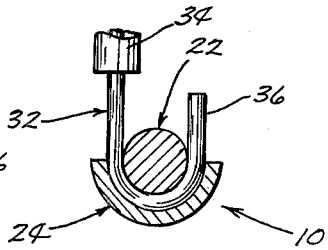
FIG. 4 is a cross sectional view taken along line 4—4 in FIG. 2.
Figure 5:
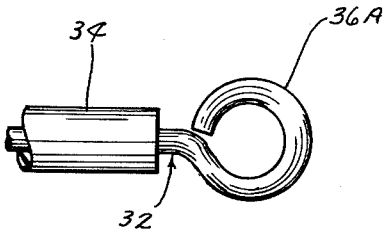
FIGS. 5–7 are fragmentary plan views of different size electrical wire end portions.
Figure 6:
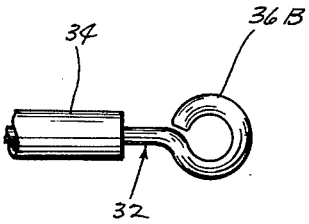
Figure 7:
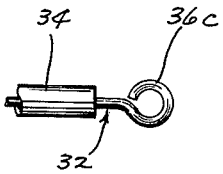

In operation it is seen that a length of wire 32 having insulation 34 thereon is stripped of the insulation on the end portion 36 and that portion is placed in the appropriate groove 28 whereupon the jaws are closed by operation of the handles 18 and 20. As seen in FIG. 4, the wire is deformed around the Mandrel-like circular in cross section finger 22 thereby forming a U-shaped end portion on the wire 32. The loop portion 36 is further shaped into a substantially circular portion **36*a* as seen in FIG. 5 by further bending through use of the jaw portions 22 and 24. Different sized loops 36*b* and 36*c* are seen in FIGS. 6 and 7, respectively, and were formed by the appropriate size grooves 28 in the tool 10.**

Figure 2:
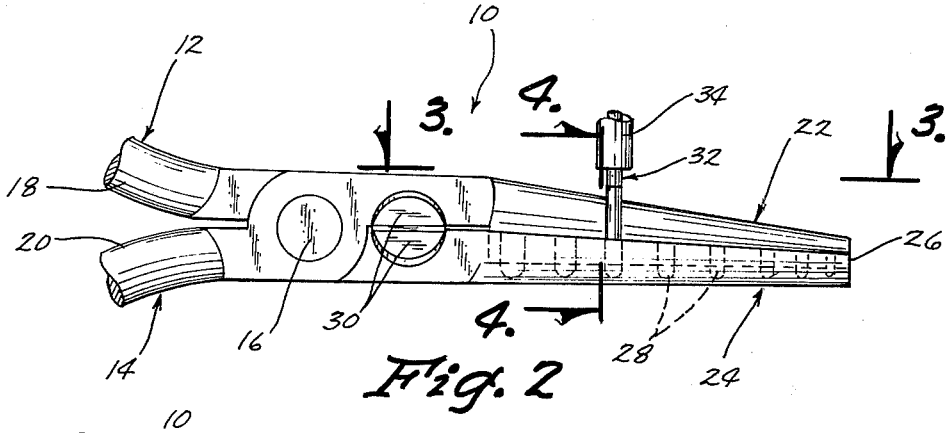
FIG. 2 is a fragmentary enlarged side elevation view thereof.
Figure 3:
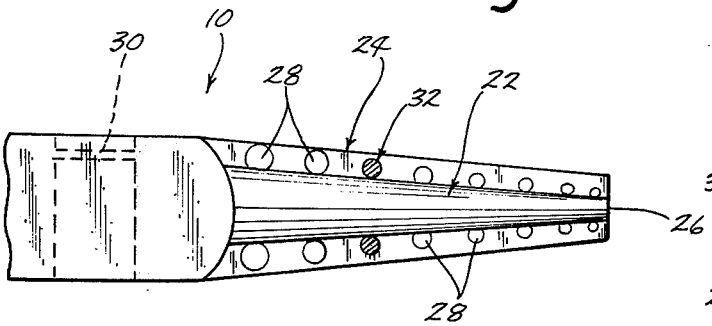
FIG. 3 is a cross sectional view taken along lines 3—3 in FIG. 2.

It is thus seen that any diameter wire may be deformed into any size loop to receive the appropriate size screw for an electrical terminal connection. It is seen in FIG. 2 that the radius of curvature of the grooves 28 increase in size from the outer and inwardly to receive larger in diameter wire portions. Ordinarily, large in diameter wire portions are formed into the larger in diameter loop portion as seen in FIGS. 5–7.

Figure 8:
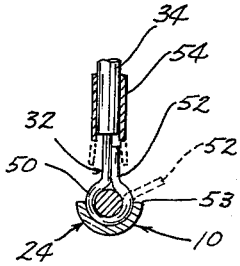
FIG. 8 is a fragmentary cross sectional view similar to FIG. 4 but illustrating a different embodiment of the invention.

In FIG. 8 an alternate embodiment of this invention is shown and includes an eye portion 50 having a free end portion 52 bent back against the main wire portion 32 by turning of the tool 10 counterclockwise. The turning movement causes the edge 53 of the finger 24 to engage the end portion 52 and cause it to close against the main wire portion 32 moving it from the dashline position to the solid line position. Prior to the deforming operation an insulative sleeve 54 is placed over the end of the wire and after the deformation is completed the sleeve 54 is moved to the dash line position to cover the end portion 52 and the exposed main wire 32 leaving only the loop 50 exposed.

I claim:

1. An electrical tool comprising, a pair of scissors members pivotally interconnected and having oppositely disposed jaw elements, one of said jaw elements having a concave semicylindrical in cross section passageway facing said other jaw and including a plurality of transversely extending grooves, said passageway increasing in diameter from its outer end inwardly, said other jaw element having a finger having a convex mating surface for mating engagement with said concave passageway, said finger increasing in diameter from the outer end inwardly whereby a length of wire placed between said jaws in one of said grooves will be deformed into an arcuate U-shaped portion upon said jaws being closed.

2. The structure of claim 1 wherein said grooves increase in cross sectional area from the outer end inwardly along the length of said one jaw element.

3. The structure of claim 1 wherein said second jaw is truncated in shape.

4. The structure of claim 1 wherein a pair of oppositely disposed cutting edges are provided on said jaws for cutting a length of wire.

* * * * *